US006048118A

United States Patent [19]

Martinez et al.

[11] Patent Number: 6,048,118

[45] **Date of Patent: *Apr. 11, 2000**

[54] COMPACT RIBBON CASSETTE WITH INTEGRAL FRICTION PLATE

[75] Inventors: Phillip M. Martinez, Groton; Scott J. Longrod, Lansing, both of N.Y.

[73] Assignee: Axiohm Transaction Solutions, Inc., Blue Bell, Pa.

[ * ] Notice: This patent is subject to a terminal disclaimer.

[21] Appl. No.: 09/131,189

[22] Filed: Aug. 7, 1998

[51] Int. Cl.[7] ..... B41J 32/00

[52] U.S. Cl. ..... 400/208; 242/421.2; 242/423.1; 242/345.1; 400/234

[58] Field of Search ..... 400/207, 208, 400/208.1, 206.3, 206.4, 234; 242/421.2, 423.1, 345.1, 615.21

[56] References Cited

U.S. PATENT DOCUMENTS

| | | | |
|---|---|---|---|
| 2,972,402 | 2/1961 | Howard | 400/234 |
| 3,726,491 | 4/1973 | Tucker | 242/338.1 |
| 3,804,227 | 4/1974 | Cappotto et al. | 400/208 |
| 3,877,561 | 4/1975 | Guerrini et al. | 400/208 |
| 4,079,827 | 3/1978 | Work | 400/234 |
| 4,437,779 | 3/1984 | Goff, Jr. et al. | 400/208 |
| 4,668,961 | 5/1987 | Hiramatsu | 400/120 |
| 4,840,502 | 6/1989 | Grey | 400/196 |
| 4,844,636 | 7/1989 | Paque | 400/208 |

FOREIGN PATENT DOCUMENTS

| | | | |
|---|---|---|---|
| 38 08 603 A1 | 9/1989 | Germany | 400/208 |

OTHER PUBLICATIONS

C. H. Hafer et al., IBM Technical Disclosure Bulletin, vol. 26, No. 11, Apr. 1984, pp. 6003–6005.

*Primary Examiner*—John S. Hilten
*Assistant Examiner*—Leslie J. Grohusky
*Attorney, Agent, or Firm*—Salzman & Levy

[57] ABSTRACT

A compact ribbon cassette for dispensing and storing a ribbon or tape upon integrally formed dispensing and storage spools. The dispensing and storage spools are disposed upon a common rotatable shaft mounted for rotation within the housing. An integral, self-adjusting friction plate bears upon the ribbon on the dispensing spool and provides a predetermined, varying drag to maintain uniform ribbon taughtness.

4 Claims, 4 Drawing Sheets

COMPACT RIBBON CASSETTE WITH INTEGRAL FRICTION PLATE

FIELD OF THE INVENTION

The present invention relates to ribbon cassettes for storing and dispensing tapes and, more particularly, to a compact ribbon cassette containing a thermal transfer printing ribbon that is both dispensed from and stored upon a common rotative shaft, and wherein the ribbon casette contains an integral, self-adjusting friction plate.

BACKGROUND OF THE INVENTION

In the field of modern transaction printers, the objective is to provide simple, compact machines that are easy both to operate and to load. Modern transaction or receipt printers are increasingly called upon to perform a variety of printing functions on a wide range of different paper documents. When a merchant accepts a check for payment for goods or services, it is desirable to verify that the check is drawn on a good account. Magnetic Ink Character Recognition (MICR) readers for reading the bank information encoded on bottom of checks have long existed as stand-alone units. More recently, the MICR readers have been packaged inside the transaction printer so that not only may the MICR characters be read and the account verified, the merchant's check endorsement may be printed on the back of the check in the same operation. The next logical extension of combining functions within transaction printers is to combine a MICR inscribing or encoding station also within the printer. The inscriber prints the amount for which the check has been written using magnetic ink in a predefined amount field area of the check thereby eliminating either a secondary check handling operation at the merchant, a service bureau, or at the bank receiving the merchant's deposit. Banks increasingly are charging commercial depositors a per-check fee for inscribing the amount field. This makes the inscribing operation at the point-of-sale terminal even more desirable. Transaction printers must be compact and the addition of a MICR-encoding station has necessitated skillful design which has required the use of an extremely compact ribbon cassette for holding the special MICR ribbon for the encoder. The present invention provides a cassette containing a direct thermal printing MICR printing tape or ribbon that is both dispensed from and stored upon spools on a common rotative shaft. The new, compact ribbon cassette takes the place of cassettes having spaced-apart, individual, dispensing and storage spools that divide the dispensing and storage functions. Such prior art spools require considerable space within the printer housing.

The invention provides a new style of ribbon cassette for transaction printers that vertically stacks the dispensing spool upon the storage spool. The dispensing and storage spool are supported upon a common shaft that is rotatively supported within the cassette housing.

Uniquely, the compact ribbon casette of the present invention contains an integral friction plate which maintains a predetermined, varying drag on the supply spool of the ribbon to insure quality printing of MICR characters on checks and other similar documents. The new ribbon cassette has a cover plate that contains integrally formed leaf springs designed to bear upon the friction plate disposed over the wound dispensing ribbon. The leaf springs in the cover plate provide biasing against the friction plate, which in turn causes a frictional loading or back drag upon the wound dispensing ribbon spool. The friction exerted upon the dispensing ribbon spool by the friction plate maintains a tension upon the dispensing spool of tape; the tape is thus kept taught as it is dispensed from the spool. This eliminates loosely formed intervals or slack in the tape as it is dispensed.

A uniquely formed chevron, disposed adjacent the dispensing and storage spools, allows for the tape to change elevation and reverse direction from the dispensing spool to the storage spool. The change of elevation allows the dispensing spool and the storage spool to be compatibly disposed for rotation upon the same shaft. In other words, the tape is dispensed from the upper, dispensing spool, changes elevation, and is then wound upon the lower storage spool.

A pair of meshing gears is provided. One gear is rotatively mounted within the housing of the cassette; the other gear is on a pivoting arm 52 biased towards the first gear. The moving, spent ribbon passes between these meshing gears, thus causing the ribbon to be positively advanced without slippage through the cassette.

SUMMARY OF THE INVENTION

In accordance with the present invention, there is provided a ribbon cassette for supplying a printing tape for encoding MICR information on a check in a transaction printer. The ribbon cassette is constructed with both a dispensing spool and a storage spool integrally formed and supported about a common rotatable shaft rotatively mounted in the cassette housing. The dispensing spool and the storage spool rotate in the same direction about the rotative shaft. A uniquely formed chevron, disposed in the housing, allows for the tape to change elevation and reverse direction from the dispensing spool to the storage spool. The changing of elevation allows the dispensing spool and storage spool to be compatibly disposed for rotation upon the common shaft. The ribbon of the dispensing spool is in contact with a friction plate that bears against the wound edges of the dispensing ribbon. A cover plate for the cassette housing is disposed over the friction plate. The cover plate contains integrally formed leaf springs that are designed to bear upon the friction plate disposed over the wound dispensing ribbon. The cover plate provides biasing against the friction plate, which in turn causes a frictional loading upon the wound dispensing ribbon which varies depending upon the remaining quantity of ribbon remaining on the dispensing spool. The friction exerted upon the dispensing ribbon by the friction plate maintains a tension upon the dispensing spool; the ribbon is thus kept taught as it is dispensed from the spool. This eliminates loosely formed intervals or slack in the ribbon during dispensing which could cause poorly formed MICR characters to be printed on the check. A pair of meshing gears is provided. One gear is rotatively mounted within the housing of the cassette; the other gear is mounted outside of the housing and biased to the gear in the housing. The moving, spent ribbon passes between these meshing gears, thus causing the ribbon to be positively advanced without slippage through the cassette.

It is an object of the invention to provide an improved, compact ribbon cassette.

It is another object of this invention to provide a ribbon cassette that has integrally formed dispensing and storage spools disposed about a common rotative shaft.

It is a further object of the invention to provide a ribbon cassette, the wound dispensing ribbon of which is biased against becoming loose within the housing of the cassette.

It is yet another object of this invention to provide a ribbon cassette that comprises a unique chevron for changing elevation and reversing the ribbon direction relative to a shaft, so that both the dispensing and storage spools can rotate upon a common shaft.

It is a still further object of the invention to provide a ribbon cassette in which the tension on the dispensing spool varies in accordance with the amount of ribbon remaining on the dispensing spool.

It is an additional object of the invention to provide a ribbon cassette with an end-of-ribbon indicating means which signals a ribbon out condition while there is still enough ribbon to complete at least the MICR encoding transaction in process.

BRIEF DESCRIPTION OF THE DRAWINGS

A complete understanding of the present invention may be obtained by reference to the accompanying drawings, when considered in conjunction with the subsequent detailed description, in which.

For purposes of brevity and clarity, like elements and components will bear the same numbering and designations throughout the figures.

DESCRIPTION OF THE PREFERRED EMBODIMENT

Generally speaking, the invention comprises a compact ribbon cassette for dispensing and storing a ribbon or tape upon integrally formed, coaxial dispensing and storage spools. The dispensing and storage spools are disposed upon a common rotatable shaft mounted for rotation within the housing. A unique chevron disposed adjacent the dispensing spool causes the dispensed ribbon to change elevation and reverse direction, so as to be presentable for storage upon the storage spool coaxially mounted with the dispensing spool. A window in the housing disposed adjacent the chevron provides a means for detecting the end portion of the dispensed ribbon, thereby alerting the operator to replace the cassette.

Figure 1:
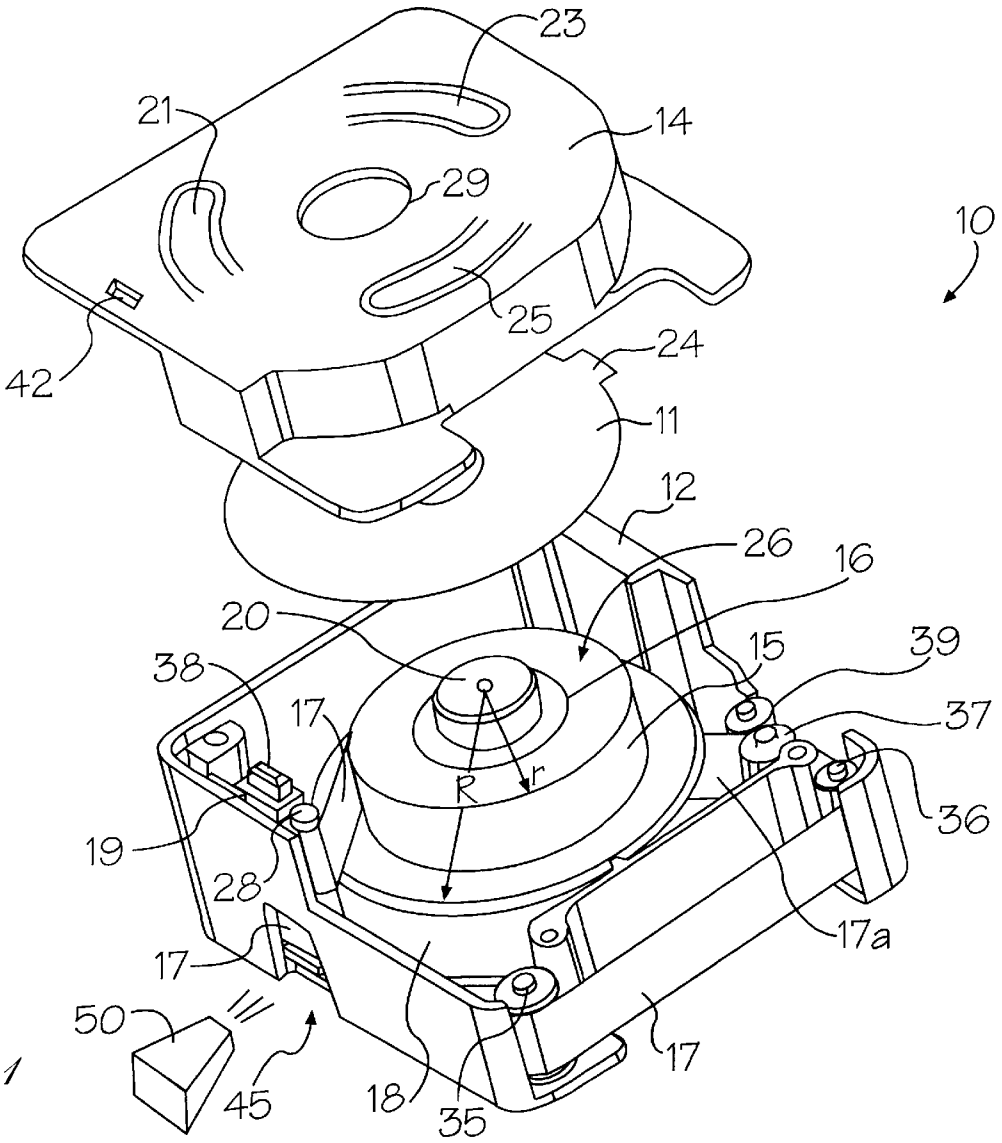
FIG. 1 illustrates a schematic, perspective, exploded, frontal view of the ribbon cassette of this invention.
Figure 2:
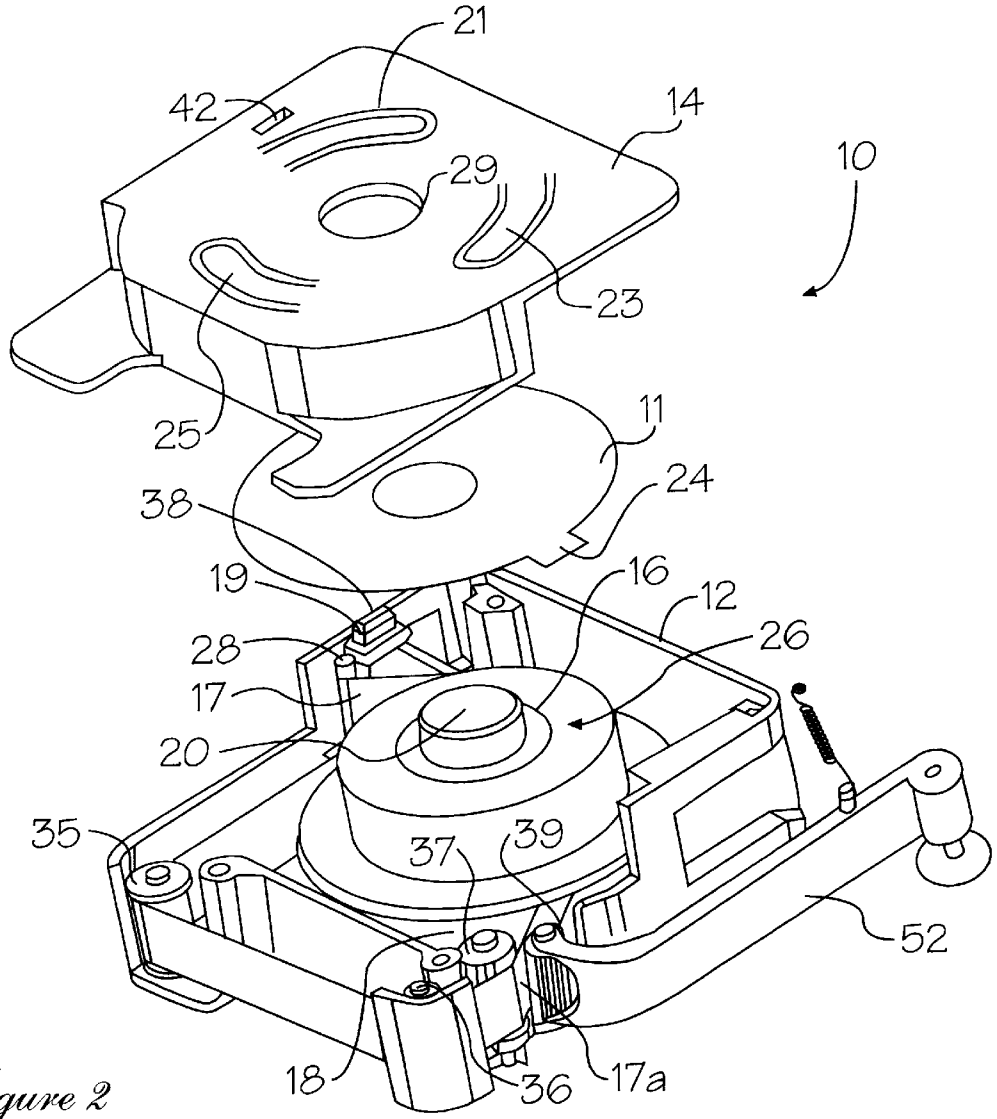
FIG. 2 depicts a schematic, perspective, exploded, left side view of the ribbon cassette of this invention.
Figure 3:
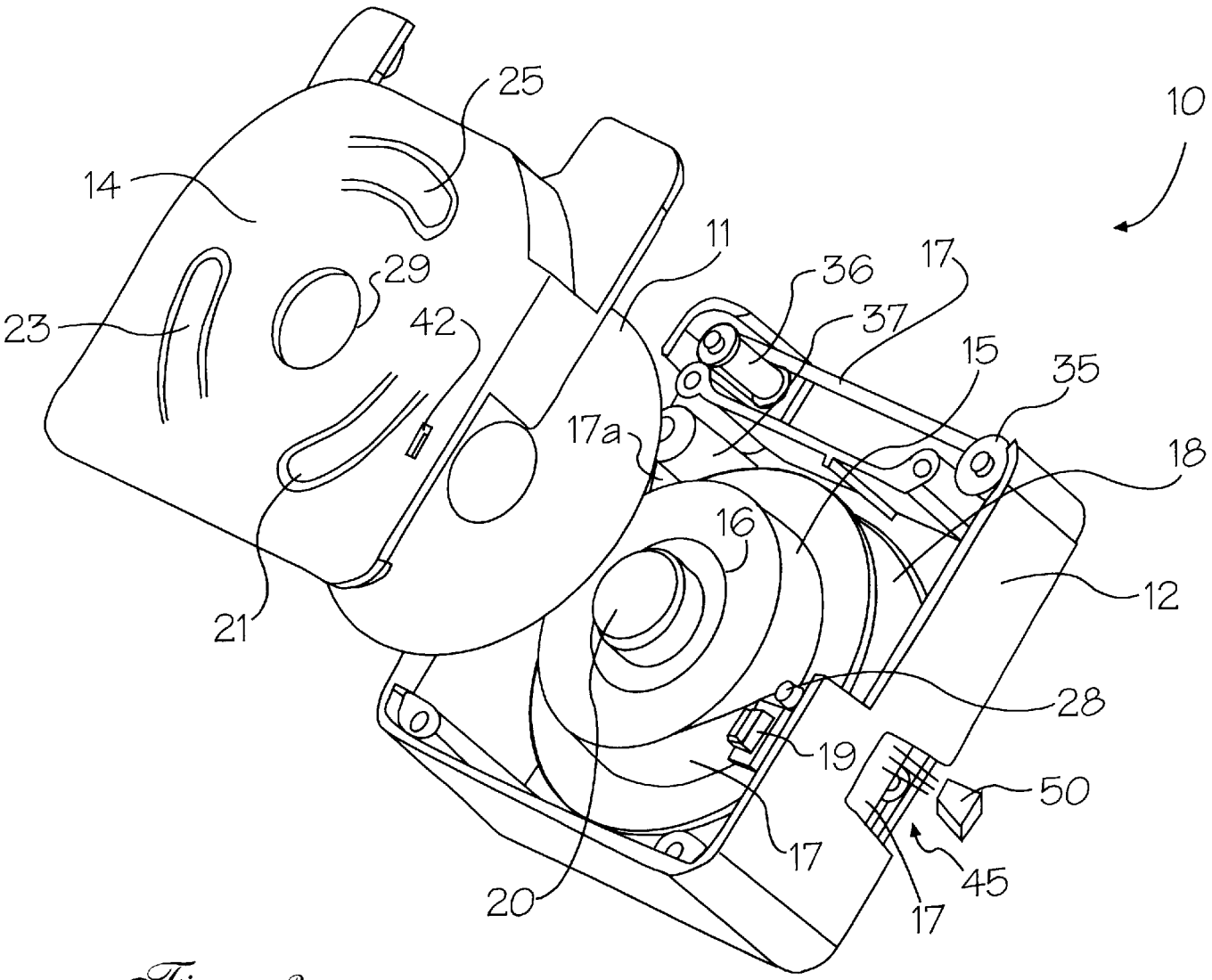
FIG. 3 shows a schematic, perspective, exploded, right side view of the ribbon cassette of this invention.

Now referring to FIGS. 1 through 3, the ribbon cassette 10 of this invention is illustrated. The ribbon cassette 10 comprises a housing 12 having a cover plate 14. A tape dispensing spool or core 16, having a dispensing tape or ribbon wound thereupon, is integrally formed and affixed to a storage spool mandrel (not shown) disposed immediately below it, within the housing 12. The storage spool mandrel stores the used tape 18 dispensed from the dispensing spool 16, allowing the tape to wind thereupon.

The respective spools of tape are wound on their respective mandrels, about a common rotatable shaft 20. The shaft 20 is rotatively mounted within the bearing hole 29 disposed in cover plate 14, and a corresponding bearing hole (not shown) disposed in the bottom of housing 12. The cover plate 14 is affixed to the housing 12, capturing the shaft 20 between the cover 14 and the housing 12.

A flexible, thin-walled friction plate 11 is disposed immediately below the cover plate 14, and is keyed to the housing 12 by tab 24. The cover plate 14 comprises three, integrally formed leaf springs or spring fingers 21, 23, and 25, respectively, formed as part of the cover plate 14. The leaf springs create a biasing against the friction plate 11 disposed below the cover plate 14. This, in turn, causes the friction plate 11 to bear against the top 26 of the wound dispensing ribbon 15, shaped like a pancake and disposed upon the dispensing spool core 16. This causes a frictional loading upon the edges of the wound dispensing ribbon pancake 15, which eliminates or substantially reduces loose gaps from forming in the dispensed ribbon 17.

As mentioned, friction plate 11 is designed as a flexible member working in conjunction with the spring fingers 21, 23 and 25 in the cover plate 14, and the changing radius of the dispensing ribbon 15. As the ribbon supply radius becomes smaller, the friction plate 11 is not supported by the wound ribbon 15 and deflects under the load of the spring fingers. The normal force on the ribbon pancake 15 is thus reduced in such a manner as to maintain a relatively uniform ribbon unwind tension.

For example, in the case where the ribbon supply pancake 15 is new, the outer radius, R, is 1.753 centimeters. The ribbon core radius, r, is 0.874 centimeters. The normal force, P, of the three spring fingers 21, 23 and 25, combined, is 50 grams. The coefficient of friction of the friction plate 11 on the ribbon pancake, $\mu$, is 0.23. The unwrapping torque on the ribbon core is $$T=\mu P[2/3(R^3-r^3/R^2-r^2)] \quad (1)$$

The unwinding tension of the ribbon is:

$$t=T/R \quad (2)$$

For a new ribbon supply pancake, where R=1.753 cm., and substituting the above values into equation (1), T=15.67 g-cm. Using this value for T, and using R=1.753 cm. for a new ribbon pancake into equation (2), the unwrapping tension of the ribbon is: t=8.94 g.

As the ribbon supply 15 is expended, the pancake radius R becomes smaller. For example, if the ribbon pancake radius is R=0.88 cm. at a point near the end of the supply, and all other parameters in equation (1) are the same, then T=10.08 g-cm. Using this value and the new value for R into equation (2), t=11.46 g. Therefore, if no other parameters are changed, the unwrapping tension increases by: 11.46 g.−8.94 g.=2.52 g.

In order to provide ribbon tensions that match both at the beginning and end of the ribbon supply pancake, either the normal force, P, or the coefficient of friction, $\mu$, must change. The easiest parameter to vary is the normal force, P, this being accomplished by the spring force compensating effect of the friction plate 11. That is, the friction plate 11 acts as a Belleville Spring as the supporting radius of the ribbon pancake 15 reduces and the friction plate 11 bends away from the three integral springs 21, 23 and 25 in the cover plate 14. The compensating spring force of the friction plate 11 can be found by using equation (2) and solving for the required torque, T, at the desired end tension, t, of 11.46 grams:

$$T=tR=8.94(0.88)$$

$$T=7.87 \text{ g-cm.}$$

Then, solving equation (1) for P:

$$P=T/\mu[2/3(R^3-r^3/R^2-r^2)] \quad (3)$$

Substituting values for T and R at the end of the ribbon supply, P=39 grams.

Therefore, the friction plate 11 is designed to bend away from the spring fingers 21, 23 and 25 in the cover 14 to reduce their force by 11 grams. As the diameter of the ribbon supply pancake 15 reduces in size, the compensating action of the friction plate 11 gradually increases.

Figure 4:
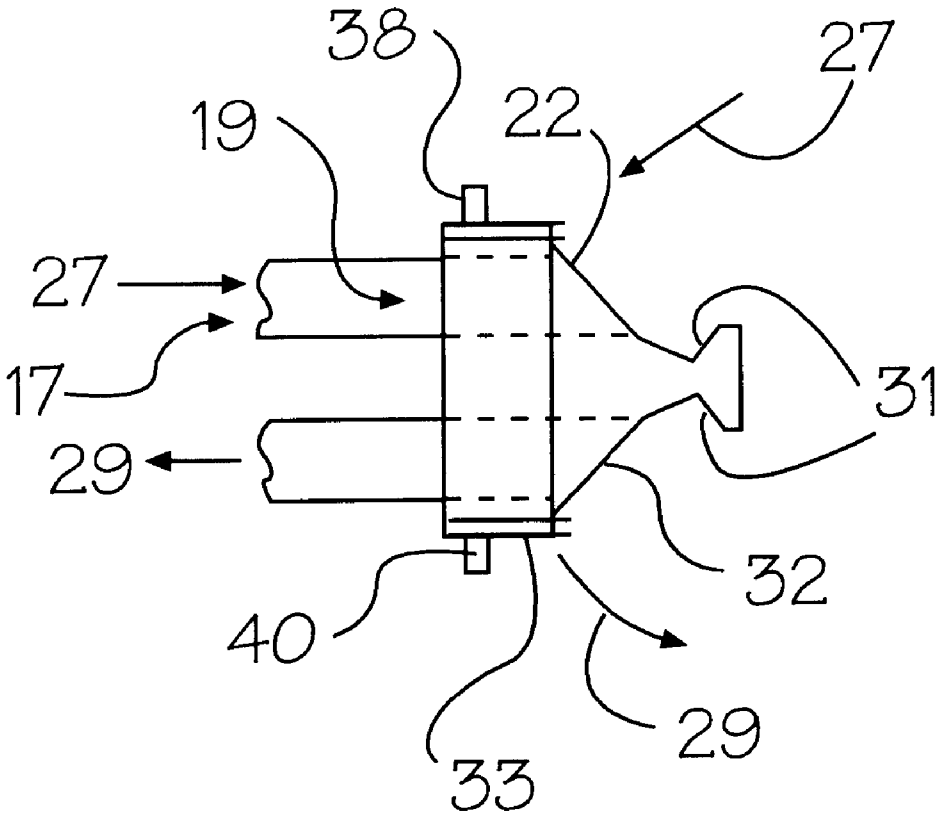
FIG. 4 illustrates a front view of the chevron disposed in the ribbon cassette of FIGS. 1 through 3, for changing elevation and reversing the ribbon direction within the cassette housing.

The dispensed ribbon 17 is fed to a uniquely designed chevron 19, shown in greater detail in FIG. 4. The dispensed tape 17 is guided (arrow 27) towards the upper diagonal surface 22 of the chevron 19 by the cylindrical capstan 28 (FIGS. 1 through 3). The dispensed ribbon 17 rides over the upper diagonal surface 22, wraps around the back of the chevron 19, and over the lower diagonal surface 32 of chevron 19. In so traversing the chevron 19, the dispensed ribbon 17 is caused to change elevation and reverse direction, as indicated by arrows 27 and 29, respectively. The dispensed ribbon 17 is now capable of being wound upon the storage spool.

A lip 31 at the distal end of the upper and lower diagonal surfaces 22 and 32, prevents the ribbon from sliding off of diagonal surfaces 22 and 32. Similar lips 33, disposed at the extreme ends of the diagonal surfaces 22 and 32, serve a similar function. The chevron 19 is affixed between the cover 14 and the housing 12 by means of upper and lower tenons 38 and 40, respectively. The upper tenon 38 fits into mortise 42 in the cover 14, and the lower tenon 40 fits into a similar mortise (not shown) in the housing 12.

The dispensed ribbon 17 is fed from the chevron 19 to the front cylindrical capstans 35 and 36, respectively, as best observed in FIGS. 1 and 2. The ribbon 17 is caused to be stretched between these two capstans 35 and 36, where it can be accessed by the thermal print head (not shown) of the MICR encoder printer. A check or other document for receiving MICR characters passes between platen and stretched printing ribbon 17. When the thermal print head contacts the back of the stretched ribbon 17 and is energized, MICR characters are printed upon the check or other document. The used ribbon 17*a* is then guided to the storage spool through two meshing gears 37 and 39, as best observed in FIG. 2. The meshing gears 37 and 39 positively capture the used ribbon 17*a*, thus causing the ribbon to be positively advanced without slippage through its passage through the cassette 10 to the storage spool. The storage spool is driven at a slightly greater speed than gears 37 and 39 through a slip clutch system (not shown). This ensures that ribbon is reliably stripped away from meshing gears 37 and 39, and wrapped tightly onto storage spool 18. The size of the drive gear 37 is chosen so that the amount of ribbon 17 advanced is equal to or slightly greater than that provided by the print platen rotation. This maximizes the quality of print of the MICR characters to assure compliance with industry standards. In the preferred embodiment, gear 37 (cassette gear) is a 15-tooth gear of approximately 0.265 inches in diameter. Gear 39 (external gear), supported on arm 52, is a 12-tooth gear of approximately 0.219 inches in diameter. In a typical application, gears 37 and 39 are rotated 720 degrees which causes ribbon 17 to be advanced approximately 1.923 inches during each ribbon advance operation.

Referring to FIGS. 1 and 3, an aperture 45 is disposed in the housing adjacent chevron 19. The purpose of the aperture 45 is to observe the ribbon 17 before it is transported to the capstans 35 and 36, for contact with the printing elements. The aperture 45 also serves as a window by which the end of the ribbon 17 can be determined. The end of the ribbon can be fitted with a silverized or otherwise reflective surface. In an alternate embodiment, the final section (not shown) of the ribbon 17 may be transparent and the portion of the cassette immediately behind the ribbon may be a reflective surface. The end of ribbon surface is displaced a sufficient distance from the printing head to ensure that the current MICR printing may be successfully completed (i.e., there is at least enough thermal ribbon to complete encoding the amount field of the check currently being processed). A photodetector 50, disposed opposite the window provided by aperture 45, can sense the reflection of its beam upon the metallized or reflective surface of the end portion of the ribbon. In so doing, the end of ribbon can be determined, thus signalling the operator to change the cassette 10 immediately after the current printing operation is completed. Alternatively, the end of ribbon may be transparent, so that light can be reflected to the photodetector 50 from an internal reflective component.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A ribbon cassette, comprising:

a housing supporting a rotatable shaft for rotation therein;

a dispensing spool of ribbon mounted for rotation upon said rotatable shaft, said dispensing spool dispensing a quantity of ribbon;

a storage spool for storing ribbon dispensed by said dispensing spool of ribbon, said storage spool mounted upon said rotatable shaft adjacent said dispensing spool wherein said dispensing spool and said storage spool are integrally formed about said rotatable shaft;

a friction plate disposed over said dispensing spool, said friction plate bearing upon the ribbon disposed upon said dispensing spool with progressively reducing force, thereby causing a reduced frictional load upon said ribbon being dispensed to compensate for a reduction in radius of said ribbon supply, whereby substantially uniform tension is maintained upon the dispensing spool, such that the ribbon is kept taught as it is dispensed from the dispensing spool;

and a cover for said housing, said cover comprising biasing means for biasing said friction plate to bear upon the ribbon of said dispensing spool, wherein said biasing means comprises at least one leaf spring supported by said cover.

2. The ribbon cassette in accordance with claim 1, wherein said at least one leaf spring supported by said cover is integrally formed therewith.

3. A ribbon cassette, comprising:

a housing supporting a rotatable shaft for rotation therein;

a dispensing spool of ribbon and a storage spool commonly mounted for rotation upon said rotatable shaft, said dispensing spool dispensing a quantity of ribbon to said storage spool;

means disposed in said housing adjacent said dispensing spool for changing elevation and direction of ribbon dispensed from said dispensing spool, whereby said storage spool is able to store the dispensed ribbon of said dispensing spool; and a friction plate disposed over said dispensing spool, said friction plate bearing upon the ribbon disposed upon said dispensing spool, thereby causing a frictional load upon said ribbon being dispensed, whereby tension is maintained upon the dispensing spool, such that the ribbon is kept taught as it is dispensed from the dispensing spool.

4. The ribbon cassette in accordance with claim 3, wherein said dispensing spool and said storage spool are integrally formed about said rotatable shaft.

* * * * *